US007084586B2

(12) United States Patent
Ishihara et al.

(10) Patent No.: US 7,084,586 B2
(45) Date of Patent: Aug. 1, 2006

(54) DISCHARGE LAMP LIGHTING APPARATUS AND DISCHARGE LAMP APPARATUS

(75) Inventors: Yutaka Ishihara, Tokyo (JP); Kazuo Okawa, Suwa (JP)

(73) Assignees: TDK Corporation, Tokyo (JP); Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/952,720

(22) Filed: Sep. 30, 2004

(65) Prior Publication Data

US 2005/0057194 A1 Mar. 17, 2005

Related U.S. Application Data

(62) Division of application No. 10/253,645, filed on Sep. 25, 2002, now Pat. No. 6,815,912.

(30) Foreign Application Priority Data

Sep. 25, 2001 (JP) ..... 2001-291761

(51) Int. Cl.
*G05F 1/00* (2006.01)

(52) U.S. Cl. ..... 315/308; 315/307

(58) Field of Classification Search ..... 315/291, 315/297, 307, 308, 224, 82
See application file for complete search history.

(56) References Cited

U.S. PATENT DOCUMENTS 5,142,203 A * 8/1992 Oda et al. ..... 315/308
5,151,631 A 9/1992 Oda et al. ..... 315/127
5,295,036 A * 3/1994 Yagi et al. ..... 361/79
5,317,237 A * 5/1994 Allison et al. ..... 315/307
5,365,152 A * 11/1994 Ozawa et al. ..... 315/307
5,463,287 A * 10/1995 Kurihara et al. ..... 315/307
5,481,163 A 1/1996 Nakamura et al. ..... 315/308
5,486,740 A * 1/1996 Yamashita et al. ..... 315/291
5,572,094 A 11/1996 Yamashita et al. ..... 315/308
5,828,177 A 10/1998 Toda et al. ..... 315/127
6,008,594 A 12/1999 Kita et al. ..... 315/307
6,046,551 A * 4/2000 Kita ..... 315/307
6,153,987 A * 11/2000 Toda et al. ..... 315/308
6,163,115 A * 12/2000 Ishizuka ..... 315/308
6,191,568 B1 * 2/2001 Poletti ..... 323/268
6,208,089 B1 3/2001 Itoh et al. ..... 315/308
6,281,642 B1 8/2001 Konishi et al. ..... 315/308
6,340,870 B1 1/2002 Yamashita et al. ..... 315/308
6,472,829 B1 10/2002 Ito et al. ..... 315/307
6,531,830 B1 3/2003 Akimoto et al. ..... 315/224
6,700,335 B1 3/2004 Prasad ..... 315/307

* cited by examiner

*Primary Examiner*—Thuy V. Tran
*Assistant Examiner*—Tung Le
(74) *Attorney, Agent, or Firm*—Oblon, Spivak, McClelland, Maier & Neustadt, P.C.

(57) ABSTRACT

The present invention relates to a discharge lamp lighting apparatus which can prevent an increase of loss and a rise of temperature in the area where discharge lamp tube voltage is low. The power conversion circuit 1 converts the input power Pin to output the DC power Pd. The discharge lamp driving circuit 5 converts the DC power Pd supplied from the power conversion circuit 1 to output AC voltage Vo and AC current Io. The controller 2 provides constant power control for maintaining the AC power Po provided by the AC voltage Vo and AC current Io to be constant when the AC voltage Vo is higher than the predetermined value V1, and provides power reduction control for reducing AC power Po to the power conversion circuit 1 when the AC voltage Vo is lower than the predetermined value V1.

2 Claims, 10 Drawing Sheets

DISCHARGE LAMP LIGHTING APPARATUS AND DISCHARGE LAMP APPARATUS

CROSS-REFERENCE TO RELATED APPLICATIONS

This application is a divisional application of U.S. application Ser. No. 10/253,645, filed Sep. 25, 2002, which is now U.S. Pat. No. 6,815,912, and claims the benefit of priority from the prior Japanese Patent Application No. 2001-291761, filed on Sep. 25, 2001 the entire contents of which are incorporated herein by reference.

BACKGROUND OF THE INVENTION

1. Field of the Invention

The present invention relates to a discharge lamp lighting apparatus for lighting a discharge lamp, such as a high-pressure mercury lamp, and a discharge lamp apparatus where the discharge lamp lighting apparatus and a discharge lamp are combined.

2. Description of the Related Art

The discharge lamp lighting apparatus converts the input power from the power supply into AC voltage and AC current for driving the discharge lamp, and supplies the AC voltage and AC current to the discharge lamp. The discharge lamp is driven by the AC voltage and AC current, and is lit. The discharge lamp tube voltage (AC voltage) of the discharge lamp fluctuates due to dispersion or time-based changes of the discharge lamp characteristics, but in the discharge lamp lighting apparatus, constant power control is performed for maintaining the discharge lamp tube power to be constant, regardless the fluctuation of the discharge lamp tube voltage.

However if the abovementioned constant power control is performed in an area where the discharge lamp tube voltage (AC voltage) is low, the discharge lamp tube current (AC current) suddenly increases as the discharge lamp tube voltage drops. The ratio of the factors which cause the loss in the discharge lamp lighting apparatus is high in a component depending on the discharge lamp tube current, and a sudden increase in the discharge lamp tube current causes an increase of loss in the discharge lamp lighting apparatus.

Also recently discharge lamp apparatuses are designed with less margin in cooling conditions to decrease the size and weight of the device, so an increase in the loss of the discharge lamp lighting apparatus easily causes a rise in the temperature of the discharge lamp lighting apparatus. If the temperature of the discharge lamp lighting apparatus rises, the overheat protection function of the discharge lamp apparatus is activated, which stops the supply of power to the discharge lamp and turns the discharge lamp OFF.

SUMMARY OF THE INVENTION

It is an object of the present invention to provide a discharge lamp lighting apparatus which can prevent an increase of loss in an area where the discharge lamp tube voltage is low, and a discharge lamp apparatus using the discharge lamp lighting apparatus.

It is another object of the present invention to provide a discharge lamp lighting apparatus which can prevent a rise in the temperature in an area where the discharge lamp tube voltage is low, and a discharge lamp apparatus using the discharge lamp lighting apparatus.

To achieve the abovementioned objects, a discharge lamp lighting apparatus according to the present invention comprises a power conversion circuit, a discharge lamp driving circuit, and a controller.

The power conversion circuit converts the input power to output DC power. The discharge lamp driving circuit converts the DC power supplied from the power conversion circuit to output AC voltage and AC current.

A signal corresponding to the AC voltage and a signal corresponding to the AC current are input to the controller. The controller provides constant power control for maintaining the AC power, which is provided by the AC voltage and AC current, to be constant to the power conversion circuit when the AC voltage is higher than a predetermined value.

The controller provides power reduction control for reducing the AC power to the power conversion circuit when the AC voltage is lower than the predetermined value.

In the abovementioned discharge lamp lighting apparatus according to the present invention, the input power is converted into DC power by the power conversion circuit. Moreover, this DC power is converted into AC voltage and AC current by the discharge lamp driving circuit, and is output. Therefore if the discharge lamp is connected to the output side of the discharge lamp driving circuit, the discharge lamp can be driven and lit by the AC voltage and AC current.

Also in the discharge lamp lighting apparatus according to the present invention, constant power control is performed for maintaining the AC power, which is provided by the AC voltage and the AC current, to be constant when the abovementioned AC voltage is higher than a predetermined value.

An important feature of the present invention is performing power reduction control to reduce the AC power when the AC voltage is lower than the abovementioned predetermined value. This power reduction control allows suppressing an increase of the AC current in an area where the AC voltage is low, which can prevent an increase of loss in the discharge lamp lighting apparatus.

Also if the increase of loss in the discharge lamp lighting apparatus in an area where the AC voltage is low is prevented, as mentioned above, a rise in the temperature of the discharge lamp lighting apparatus can be prevented as well, and activation of the overheat protection function and the discharge lamp turning OFF due to this activation can also be solved.

Also in the discharge lamp lighting apparatus according to the present invention, the abovementioned constant power control and the power reduction control are executed for the power conversion circuit which outputs the DC power, so these controls are simple.

It is preferable that the power reduction control has the characteristic to reduce the AC power according to the difference between the AC voltage and the abovementioned predetermined value. According to this power reduction control characteristic, an increase of the AC current in an area where the AC voltage is low can be suppressed effectively.

Generally in an area where the AC voltage (discharge lamp tube voltage) is low, the luminance of the discharge lamp does not drop very much, even if the AC power (discharge lamp tube power) is reduced slightly. Therefore the abovementioned power reduction control can be performed in a range where the luminance of the discharge lamp does not drop.

Another mode of the discharge lamp lighting apparatus according to the present invention may comprise a power conversion circuit, a high voltage generator, and a controller.

The power conversion circuit converts input power to output DC power. The high voltage generator receives the supply of the DC power from the power conversion circuit, and outputs DC voltage and DC current for driving a discharge lamp.

The controller, to which a signal corresponding to the DC voltage and a signal corresponding to the DC current are input, provides constant power control for maintaining the DC power, which is provided by the DC voltage and the DC current, to be constant to the power conversion circuit when the DC voltage is higher than a predetermined value, and provides power reduction control for reducing the DC power to the power conversion circuit when the DC voltage is lower than the predetermined value.

The discharge lamp lighting apparatus according to this mode as well exhibits a functional effect similar to the discharge lamp lighting apparatus described first.

Other objects, configurations and advantages of the present invention will be described in detail with reference to the accompanying drawings. The drawings, however, merely show examples.

DESCRIPTION OF THE PREFERRED EMBODIMENTS

Figure 1:
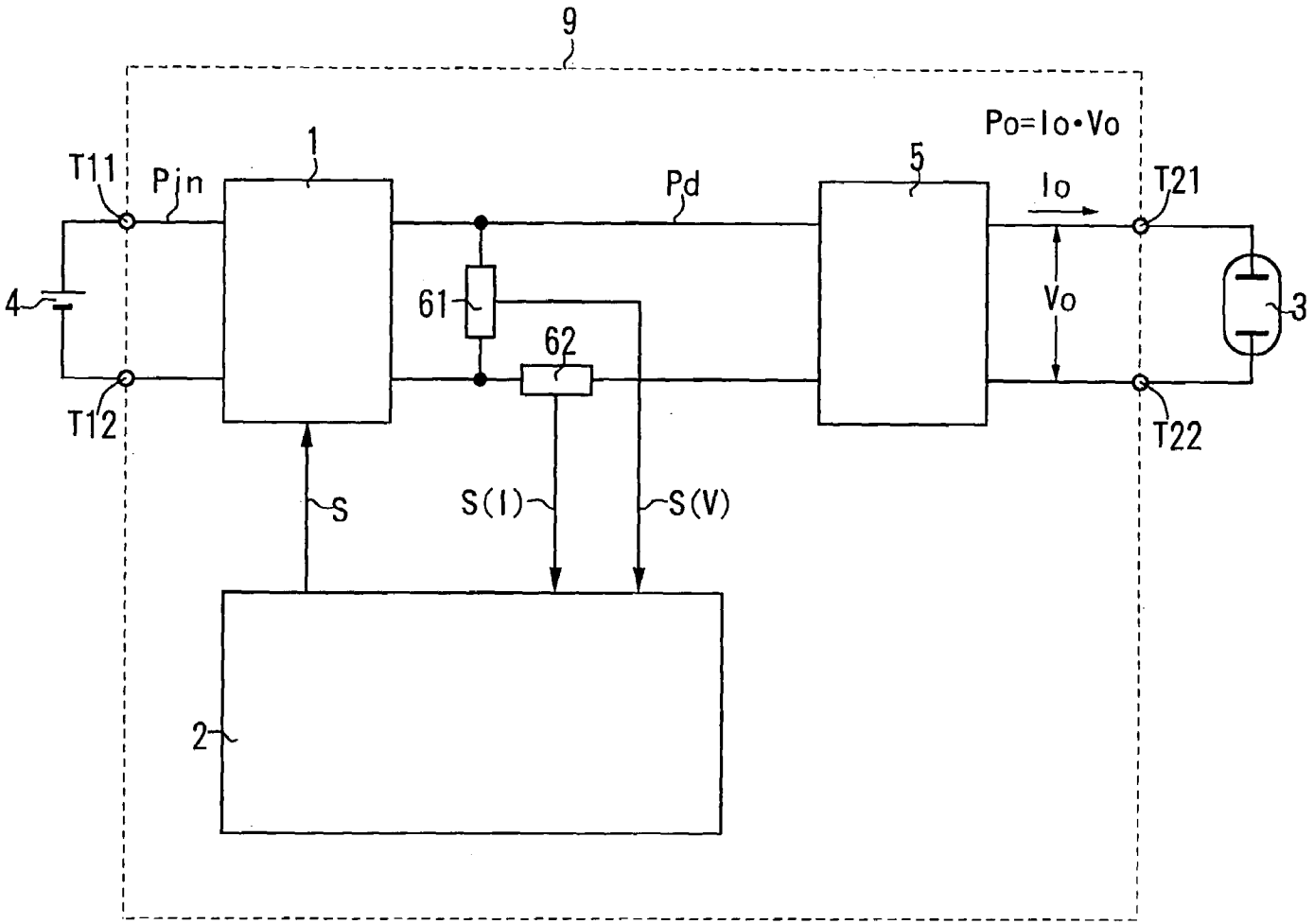
FIG. 1 is a block diagram depicting a configuration of the discharge lamp lighting apparatus according to the present invention.

Referring to FIG. 1, the discharge lamp lighting apparatus 9 according to the present invention comprises a power conversion circuit 1 and a discharge lamp driving circuit 5. The reference numeral 3 indicates a discharge lamp, such as a high-pressure mercury lamp. The reference numeral 4 is a power supply. The power supply 4 in FIG. 1 is a DC power supply, for which either a battery or voltage where AC voltage is converted into DC via a rectifying smoothing circuit can be used. The power supply 4 may be either an internal component or an external component of the present invention.

The power conversion circuit 1 converts the input power Pin, which is input from the power supply 4 to the input terminals T11 and T12, and outputs the DC power Pd. In the present embodiment, the input power Pin from the power supply 4 is DC, and the power conversion circuit 1 is comprised of a DC-DC converter. The DC-DC converter, constituting the power conversion circuit 1, switches the DC input power Pin, which is input to the input terminals T11 and T12, converts the switched output into DC power Pd, and outputs the DC power Pd. The switching frequency can be set to a 10–500 kHz value, for example.

The discharge lamp driving circuit 5 converts the DC power Pd, which is supplied from the power conversion circuit 1, and outputs the AC voltage Vo and AC current lo to the output terminals T21 and T22. The AC voltage Vo and AC current lo are an AC voltage and AC current appropriate for driving the discharge lamp respectively.

The discharge lamp 3 is connected to the output side of the discharge lamp driving circuit 5. More specifically, one electrode of the discharge lamp 3 is connected to one output terminal T21 of the discharge lamp driving circuit 5, and the other electrode thereof is connected to the other output terminal T22. The AC voltage Vo and AC current Io from the discharge lamp driving circuit 5 are supplied to the discharge lamp 3 via the output terminals T21 and T22.

The abovementioned discharge lamp lighting apparatus 9 also includes a controller 2. Voltage detection signal S(V) corresponding to the abovementioned AC voltage Vo is input to the controller 2. The voltage detection signal S(V) is obtained by detecting the voltage which appears at the output side of the power conversion circuit 1 by the voltage detector 61. The voltage detector 61 is installed at the output side of the power conversion circuit 1 and the input side of the discharge lamp driving circuit 5. The output voltage of the power conversion circuit 1 is DC voltage, but includes the voltage information of the AC voltage Vo to be supplied to the discharge lamp 3, and the voltage detection signal S(V) corresponds to the abovementioned AC voltage Vo.

Also the current detection signal S(I) corresponding to the abovementioned AC current lo is input to the controller 2. The current detection signal S(I) is obtained by the current detector 62 for detecting current which flows in the power supply line. The current detector 62 is installed at the output side of the power conversion circuit 1 and the input side of the discharge lamp driving circuit 5. The current which flows in the power supply line is substantially equivalent to the AC current lo which flows through the discharge lamp 3, and the current detection signal S(I) corresponds to the above AC current lo.

The controller 2 provides power control S to the abovementioned power conversion circuit 1. Now the specific content of the power control S will be described.

Figure 2A:
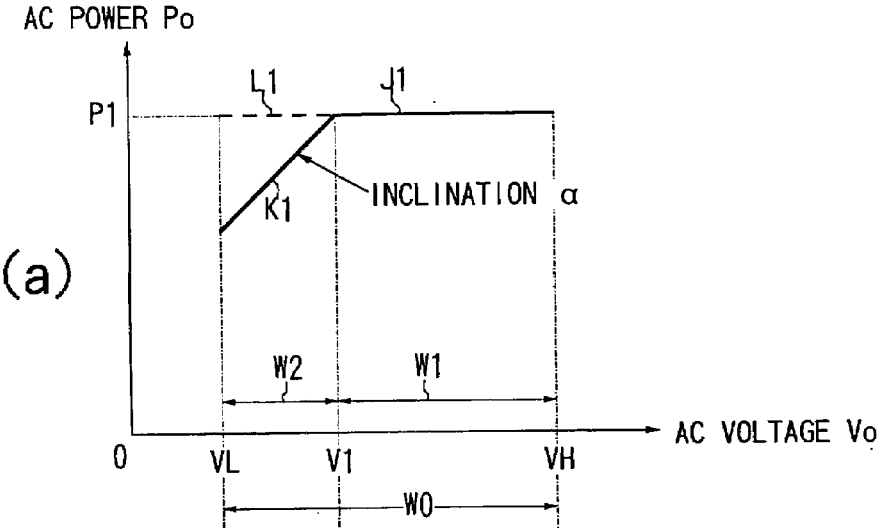
FIG. 2 is a diagram depicting an example of power control in the discharge lamp lighting apparatus according to the present invention.
Figure 2B:
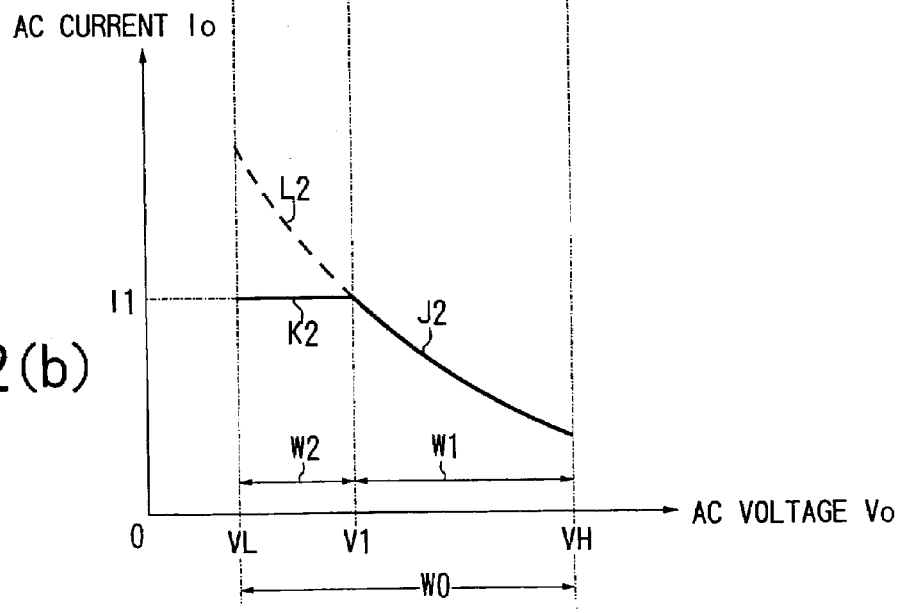

FIG. 2 is a diagram depicting an example of power control in the discharge lamp lighting apparatus according to the present invention. FIG. 2 (a) shows the AC voltage—AC power characteristic. In FIG. 2(*a*), the abscissa shows the AC voltage Vo which is output from the discharge lamp driving circuit 5, and the ordinate shows the AC power Po which is output from the discharge lamp driving circuit 5. The AC power Po is provided by the AC voltage Vo and the AC current Io.

FIG. 2(*b*) shows the AC voltage—AC current characteristic. In FIG. 2(*b*), the abscissa is common with the abscissa of FIG. 2(*a*), and the ordinate shows the AC current Io which is output from the discharge lamp driving circuit 5.

In FIG. 2(*a*) and FIG. 2(*b*), the reference symbol W0 shows the stable voltage area of the discharge lamp 3, and the reference symbols VH and VL are the stable voltage upper limit value and the stable voltage lower limit value of the stable voltage area W0 respectively.

As the solid line J1 in FIG. 2(*a*) shows, the controller 2 provides constant power control for maintaining the AC power Po to be constant to the power conversion circuit 1 when the AC voltage Vo is higher than the predetermined value V1. More specifically, the predetermined value V1 is set between the stable voltage upper limit value VH and the stable voltage lower limit value VL of the stable voltage area W0, and the abovementioned constant power control is provided when the AC voltage Vo is in the area W1 from the predetermined value V1 to the stable voltage upper limit value VH. The constant power control is control for maintaining the AC power Po to be a steady-state power value P1 (constant value), and fixes the power command value Pa of the AC power Po to the steady-state power value P1. The steady-state power value P1 is determined considering the characteristics of the discharge lamp 3.

Also as the solid line K1 in FIG. 2(*a*) shows, the controller 2 provides power reduction control for reducing the AC power Po to the power conversion circuit 1 when the AC voltage Vo is lower than the predetermined value V1. Compared with the abovementioned constant power control, this power reduction control is a control for decreasing the AC power Po to be lower than the steady-state power value P1 (constant value) by the constant power control. The power reduction control is provided when the AC voltage Vo is in the area W2 from the predetermined value V1 to the stable voltage lower limit value VL.

In this embodiment, the characteristic of the abovementioned power reduction control is a characteristic for reducing the AC power Po according to the difference between the AC voltage Vo and the predetermined value V1. More specifically, the power reduction control characteristic decreases the AC power Po for an amount in proportion to the difference (V1−Vo) between the AC voltage Vo and the predetermined value V1, which is a simple reduction characteristic. Namely, the power command value Pa under the power reduction control is given by the following formula (1) using the AC voltage Vo at that time.

$$Pa = P1 - \alpha \cdot (V1 - Vo) \text{ (where } Vo < V1) \quad (1)$$

In the above formula (1), the value α is a constant value, and is determined considering the characteristics of the discharge lamp 3, power conversion circuit 1 or the discharge lamp driving circuit 5. Another characteristic to reduce the AC power according to the difference between the AC voltage and the predetermined value is a curved reduction characteristic, for example.

The power reduction control characteristic is not limited to the simple reduction characteristic in FIG. 2. For example, the power reduction control characteristic may be a curved reduction characteristic or a step reduction characteristic. Or the power reduction control characteristic may be a characteristic for reducing the AC power according to various functions depending on the discharge characteristic of the discharge lamp.

As described above with reference to FIG. 1, in the discharge lamp lighting apparatus 9 according to the present invention, the input power Pin is converted into DC power Pd by the power conversion circuit 1, and this DC power Pd is converted to the AC voltage Vo and AC current Io by the discharge lamp driving circuit 5, and is output. Therefore if the discharge lamp 3 is connected to the output side of the discharge lamp driving circuit 5, the discharge lamp 3 is driven and lit by the AC voltage Vo and the AC current Io.

Also as the solid line J1 in FIG. 2(*a*) shows, constant power control for maintaining the AC power Po, which is provided by the AC voltage Vo and AC current Io, to be constant is performed when the AC voltage Vo is higher than the predetermined value V1.

In a conventional discharge lamp lighting apparatus, constant power control is performed even in an area where the AC voltage Vo is low. For example, as the broken line L1 in FIG. 2(*a*) shows, constant power control is performed even in the area where the AC voltage Vo is low, so as to maintain the AC power Po to be the steady-state power value P1 (constant value). As a result, as the broken line L2 in FIG. 2(*b*) shows, the AC current Io suddenly increases as the AC voltage Vo drops, and this sudden increase in the AC current Io causes an increase of loss in the discharge lamp lighting apparatus.

In the case of the discharge lamp lighting apparatus 9 of the present invention, on the other hand, power reduction control for reducing the AC power Po is performed when the AC voltage Vo is lower than the predetermined value V1 (see the solid line K1 in FIG. 2 (*a*)). By the abovementioned power reduction control, the increase of the AC current Io in the area W2 where the AC voltage Vo is low can be suppressed (see the solid line K2 in FIG. 2(*b*)), and an increase of loss in the discharge lamp lighting apparatus 9 can be prevented.

Also if the increase of loss in the discharge lamp lighting apparatus 9 in the area W2 where the AC voltage Vo is low is prevented, as mentioned above, a rise in the temperature of the discharge lamp lighting apparatus 9 is also prevented, and the activation of the overheat protection function and the turning OFF of the discharge lamp 3 due to this activation can also be solved.

Also in the discharge lamp lighting apparatus 9 according to the present invention, the abovementioned constant power control and power reduction control are executed for the power conversion circuit 1 which outputs the DC power Pd, so these controls are simple.

In the present embodiment, a characteristic of the abovementioned power reduction control is a characteristic for reducing the AC power Po according to the difference between the AC voltage Vo and the predetermined value V1. According to this power reduction control characteristic, an increase of the AC current Io can be effectively suppressed.

Generally in the area W2 where the AC voltage Vo (discharge lamp tube voltage) is low, the luminance of the discharge lamp 3 does not drop very much, even if the AC power Po (discharge lamp tube power) is reduced slightly. Therefore the abovementioned power reduction control can be performed within a range where the drop in luminance of the discharge lamp 3 does not become a problem.

As the solid line K2 in FIG. 2(*b*) shows, the controller 2 suppresses an increases of the AC current Io by the abovementioned power reduction control in the area W2 where the AC voltage Vo is low. This AC current increase suppression characteristic is closely related to the abovementioned power reduction control characteristic.

The AC current increase suppression characteristic shown in FIG. 2(*b*) is a characteristic which maintains the AC current Io to be the constant value I1, but this invention is not limited to this characteristic. For example, the AC current increase suppression characteristic may be a characteristic which reduces the AC current as the AC voltage drops, or a characteristic which decreases the AC current to lower than the AC current shown by the conventional characteristic (broken line L2).

Figure 3A:
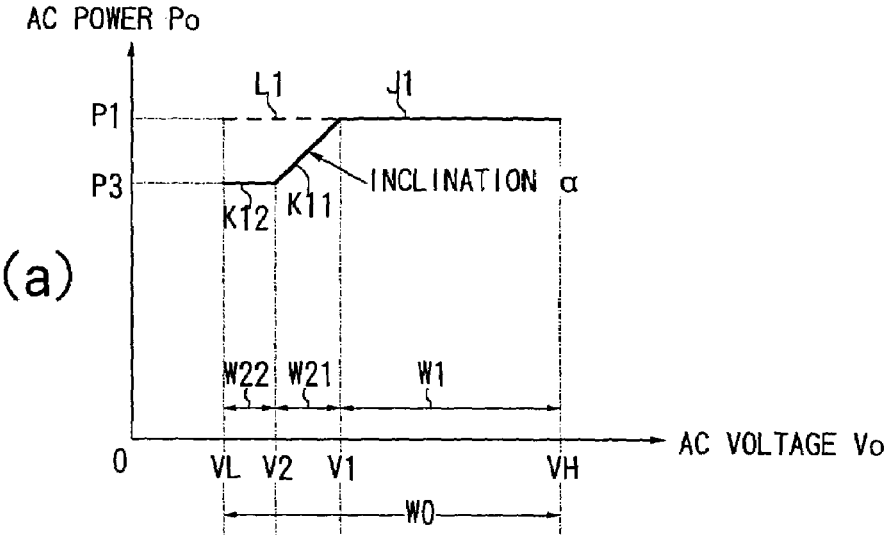
FIG. 3 is a diagram depicting another example of power control in the discharge lamp lighting apparatus according to the present invention.
Figure 3B:
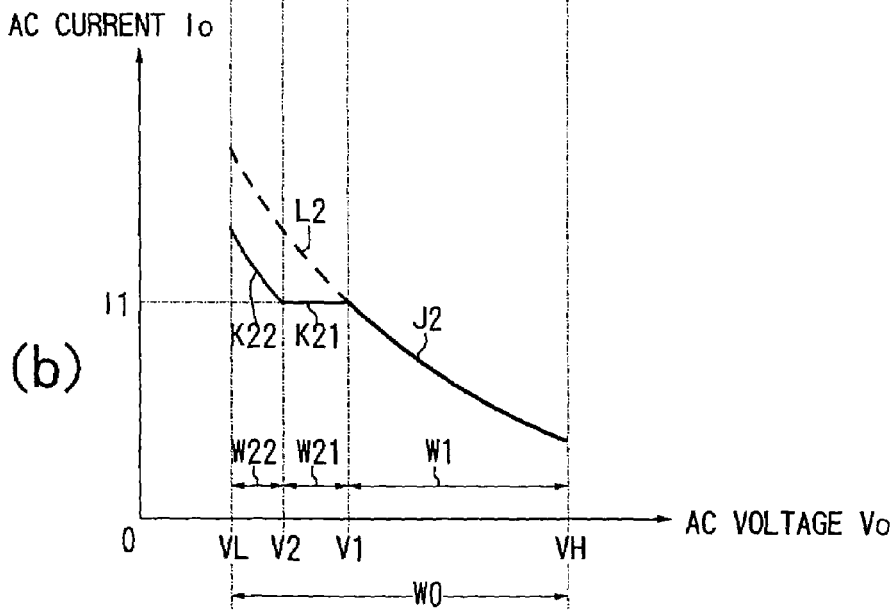

FIG. 3 is a diagram depicting another example of power control in the discharge lamp lighting apparatus according to the present invention. FIG. 3(*a*) shows the AC voltage—AC power characteristic, where the abscissa and the ordinate are the same as FIG. 2(*a*). FIG. 3(*b*) shows the AC voltage—AC current characteristic, where the abscissa and the ordinate are the same as FIG. 2(*b*).

Compared with the power control described with reference to FIG. 2, in this power control, the lower limit power value P3 is set for power reduction control to prevent the AC power Po from dropping too much by power reduction control. Specifically, this power reduction control includes a control for reducing the AC power Po according to the difference between the AC voltage Vo and the predetermined value V1 when the AC voltage Vo is in the area W21 from the predetermined value V1 to the value V2 (see the solid line K11 in FIG. 3(*a*)), and a control for maintaining the AC power Po to be the lower limit power value P3 when the AC voltage Vo is in the area W22 from the value V2 to the stable voltage lower limit value VL in the stable voltage area W0 (see the solid line K12 in FIG. 3(*a*)). The value V2 is set to a value lower than the predetermined value V1 and higher than the stable voltage lower limit value VL. The lower limit power value P3 is given by the following formula (2), for example, using the steady-state power value P1, the predetermined value V1 and the value V2.

$$P3=P1-\alpha\cdot(V1-V2) \tag{2}$$

As the solid lines K21 and K22 in FIG. 3(*b*) show, the controller 2 suppresses an increase of the AC current Io by the abovementioned power reduction control in the areas W21 and W22 where the AC voltage Vo is low.

Figure 4:
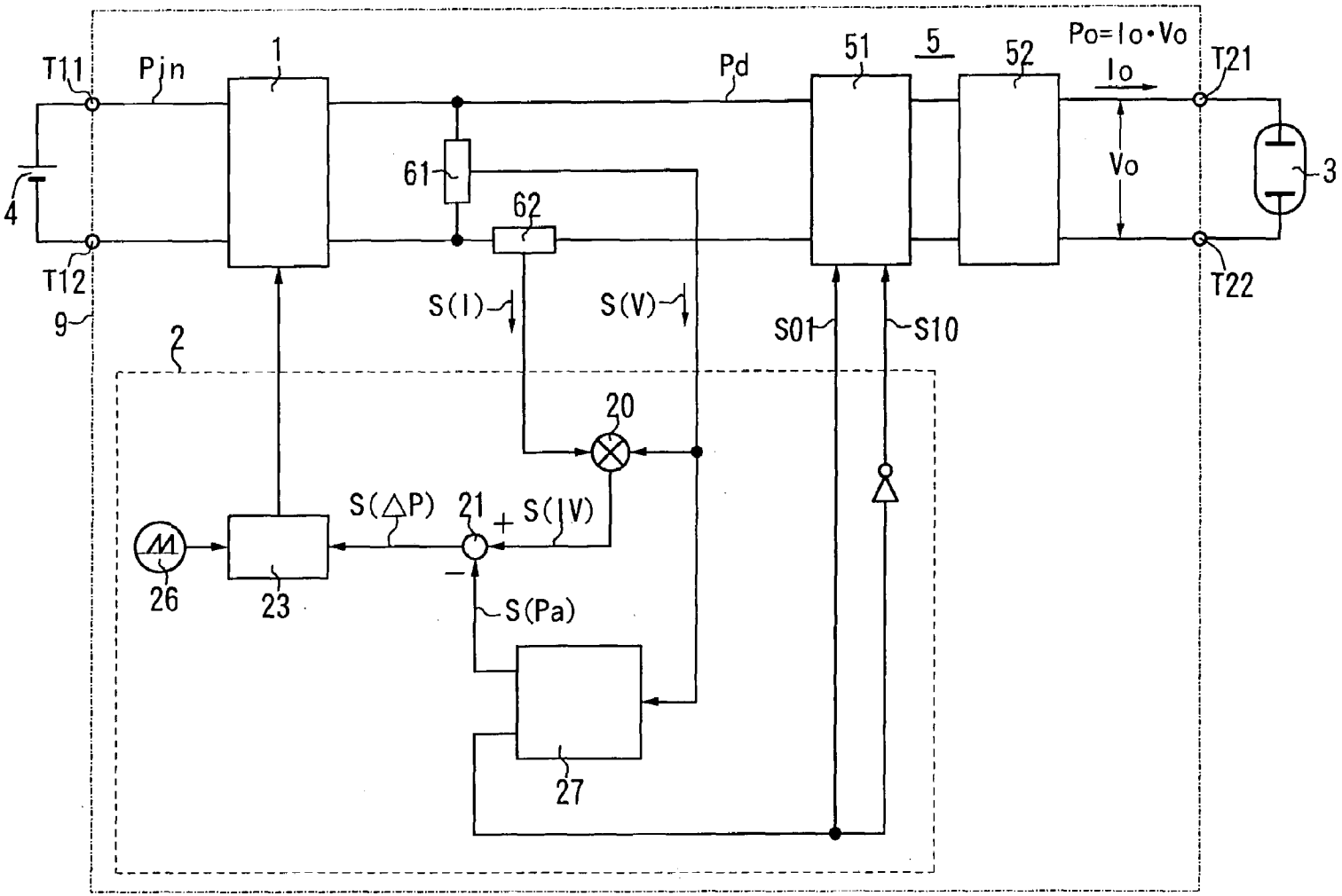
FIG. 4 is a block diagram depicting a specific configuration of the discharge lamp lighting apparatus shown in FIG. 1.

FIG. 4 is a block diagram depicting a specific configuration of the discharge lamp lighting apparatus shown in FIG. 1. In the discharge lamp lighting apparatus 9 in FIG. 4, the controller 2 comprises a power computing section 20, a signal processing section 27, a signal generating section 21, and a pulse width controlling section 23.

The power computing section 20, to which the voltage detection signal S(V) from the voltage detector 61 and the current detection signal S(I) from the current detector 62 are supplied, computes power from the voltage detection signal S(V) and current detection signal S(I) to generate the power detection signal S(IV). This power detection signal S(IV) corresponds to the abovementioned AC power Po which is output from the discharge lamp driving circuit 5.

The signal processing section 27, to which the voltage detection signal S(V) is supplied, outputs the power command signal S(Pa) according to the voltage detection signal S(V). Specifically the power command signal S(Pa) indicates the power command value Pa, and the power command value Pa is calculated according to the AC voltage Vo indicated by the voltage detection signal S(V). Now calculation process of the power command value Pa will be described.

Figure 5:
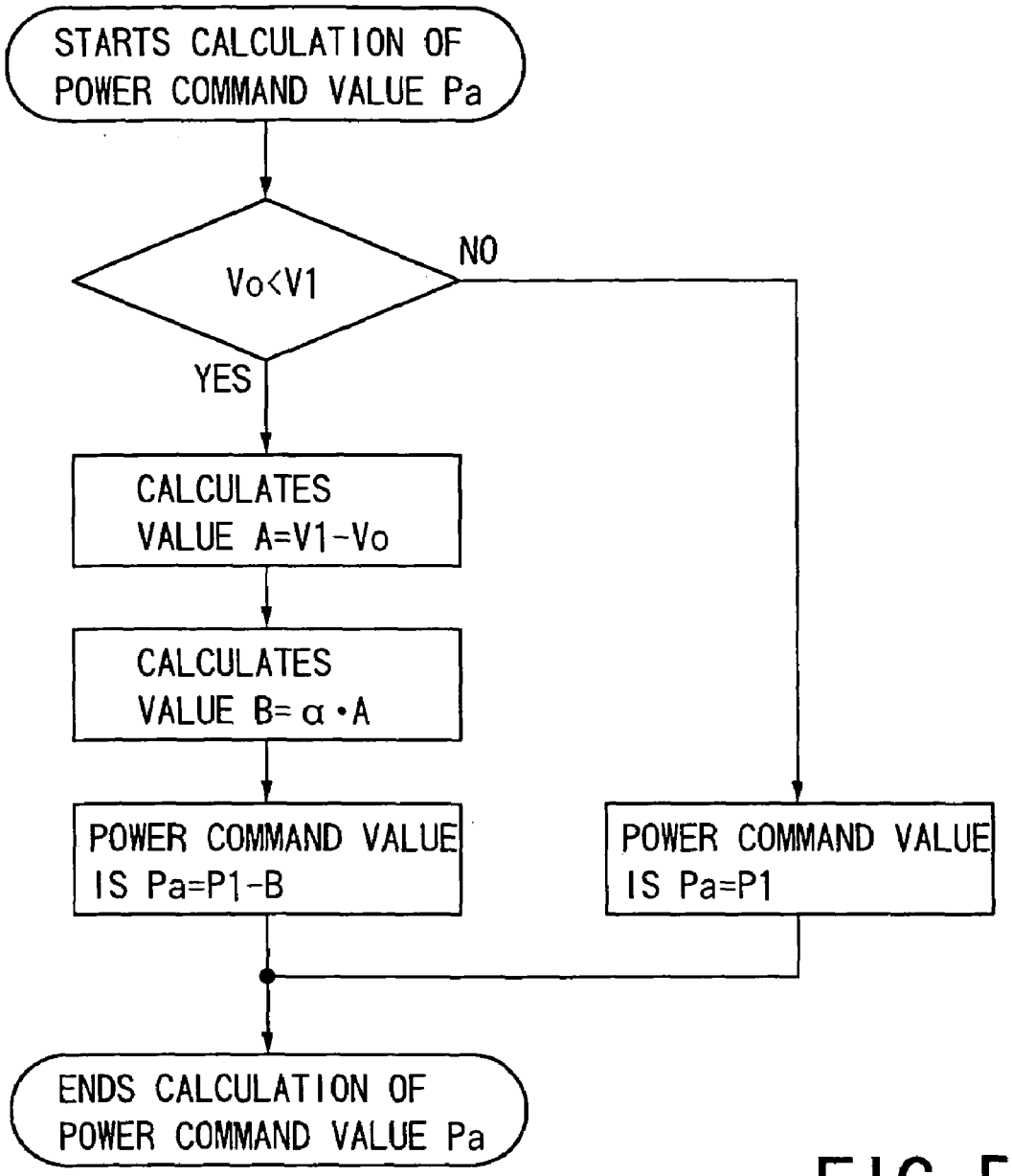
FIG. 5 is a flow chart depicting calculation process for the power command value Pa for the power control described in FIG. 2.

FIG. 5 is a flow chart depicting the calculation process of the power command value Pa when the power control described in FIG. 2 is performed. In this case, the signal process section 27 first judges whether the AC voltage Vo is lower than the predetermined value V1. If the AC voltage Vo is not lower than the predetermined value V1, the signal processing section 27 provides the steady-state power value P1 as the power command value Pa.

If the AC voltage Vo is lower than the predetermined value V1, the signal processing section 27 calculates the value A (=V1−Vo), calculates the value B (=α·A) using the value A, and calculates the value (P1−B) using the value B. And the signal processing section 27 provides the value (P1−B) as the power command value Pa. Namely, the power command value Pa is given by the abovementioned formula (1).

Figure 6:
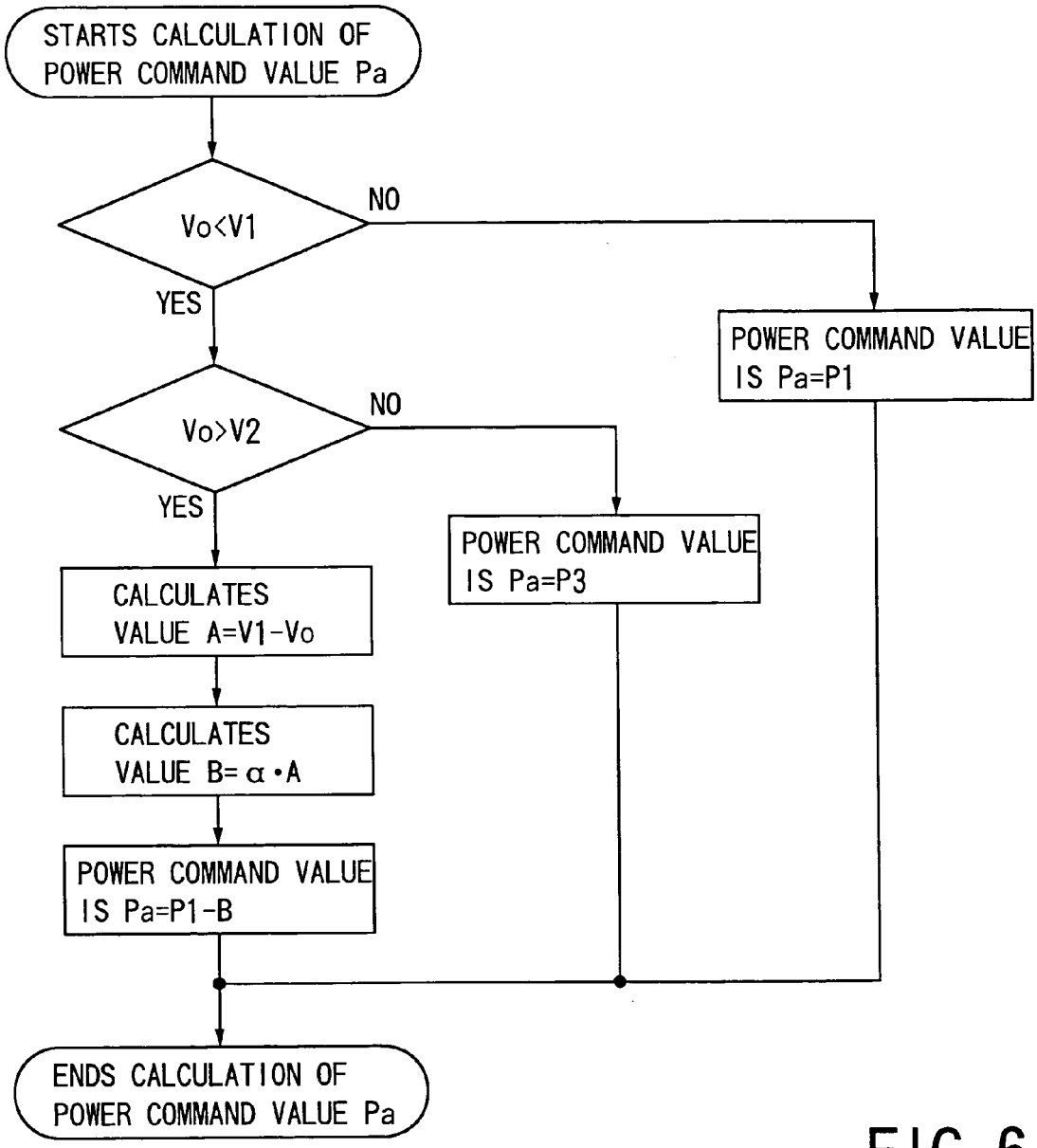
FIG. 6 is a flow chart depicting calculation process for the power command value Pa for the power control described in FIG. 3.

FIG. 6 is a flow chart depicting the calculation process of the power command value Pa when the power control described in FIG. 3 is performed. In this case as well, the signal processing section 27 first judges whether the AC voltage Vo is lower than the predetermined value V1. If the AC voltage Vo is not lower than the predetermined value V1, the signal processing section 27 provides the steady-state power value P1 as the power command value Pa.

If the AC voltage Vo is lower than the predetermined value V1, the signal processing section 27 judges whether the AC voltage Vo is higher than the value V2. If the AC voltage Vo is not higher than the value V2, the signal processing section 27 provides the lower limit power value P3 as the power command value Pa. The lower limit power value P3 is given by the abovementioned formula (2).

If the AC voltage Vo is higher than the value V2, the signal processing section 27 calculates the value A (=V1−Vo) just like the calculation process shown in FIG. 5, calculates the value B (=α·A) using the value A, and calculates the value (P1−B) using the value B. And the signal processing section 27 provides the value (P1−B) as the power command value Pa.

The signal processing section 27 outputs the power command signal S(Pa) of the power command value Pa obtained by one of the abovementioned calculation processes. The signal processing section 27 can be comprised of a dedicated or general purpose IC for control, or a microcomputer.

Now the signal generating section 21 and the pulse width controlling section 23 will be described with reference to FIG. 4. To the signal generating section 21, the power detection signal S(IV) is supplied from the power computing section 20, and the power command signal S(Pa) is supplied from the signal processing section 27. And the signal processing section 21 outputs the signal S(ΔP) which corresponds to the difference between the power detection signal S(IV) and the power command signal S(Pa).

The pulse width controlling section 23 provides pulse width control to the power conversion circuit 1, which is comprised of the DC-DC converter, based on the signal S(ΔP) supplied from the signal generating section 21. More specifically, the pulse width controlling section 23 has a triangular wave oscillation circuit 26, and generates a signal having a pulse width according to the signal S(ΔP) by using the triangular wave signal which is supplied from the triangular wave oscillation circuit 26 and the signal S(ΔP) which is supplied from the signal generating section 21, and supplies this signal to the power conversion circuit 1 (DC-DC converter) to control the switching operation thereof.

When the power conversion circuit 1 (DC-DC converter) performs the switching operation by the abovementioned pulse width control, the DC voltage and the DC current which appear at the output side of the power conversion circuit 1 are detected by the voltage detector 61 and the current detector 62. And the voltage detection signal S(V) and the current detection signal S(I) are supplied to the power computing section 20, and the power detection signal S(IV) is supplied from the power computing section 20 to the signal generating section 21. In addition, the abovementioned voltage detection signal S(V) is also supplied to the signal processing section 27, and the power command signal S(Pa) is supplied from the signal processing section 27 to the signal generating section 21.

In the signal generating section 21, the power detection signal S(IV) from the power computing section 20 is compared with the power command signal S(Pa) from the signal processing section 27, and the signal S(ΔP) corresponding to the difference is generated. And the pulse width control according to the signal S(ΔP) is provided to the power conversion circuit 1 by the pulse width controlling section 23. The pulse width controlling direction in this case is the direction where the difference between the power detection signal S(IV) and the power command signal S(Pa) decreases.

By the abovementioned feedback control, control to make the difference between the power detection signal S(IV) and the power command signal S(Pa) to be zero is provided. The power detection signal S(IV) corresponds to the AC power Po which is output from the discharge lamp driving circuit 5, and control to make the AC power Po to be the same as the power command value Pa of the power command signal S(Pa) is provided.

In the discharge lamp lighting apparatus 9 shown in FIG. 4, the discharge lamp driving circuit 5 comprises an inverter 51 and a high voltage generator 52. The inverter 51 converts the DC power PD, which is output from the power conversion circuit 1, into AC power, and outputs it. The inverter 51 is a type of square-wave generating circuit, and generates square-shaped AC pulse voltage and AC pulse current. The inverter 51 is driven by the drive pulse signals S10 and S01, which are supplied from the abovementioned signal processing section 27. The drive pulse signal S10 is obtained by inverting the drive pulse signal S01, and becomes low level (logic value 0) when the drive pulse signal S01 is at high level (logic value 1), and becomes high level (logic value 1) when the drive pulse signal S01 is at low level (logic value 0).

The switching frequency of the inverter 51, which is determined by the drive pulse signals S10 and S01, is selected to be a value lower than the switching frequency of the DC-DC converter constituting the power conversion circuit 1. For example, the switching frequency in the DC-DC converter constituting the power conversion circuit 1 is selected to be 10–500 kHz, and the switching frequency of the inverter 51 is selected to be 50–500 Hz.

The high voltage generator 52 is installed at the subsequent stage of the abovementioned inverter 51. The high voltage generator 52 generates the voltage required for lighting the discharge lamp 3, and supplies the voltage to the output terminals T21 and T22.

Figure 7:
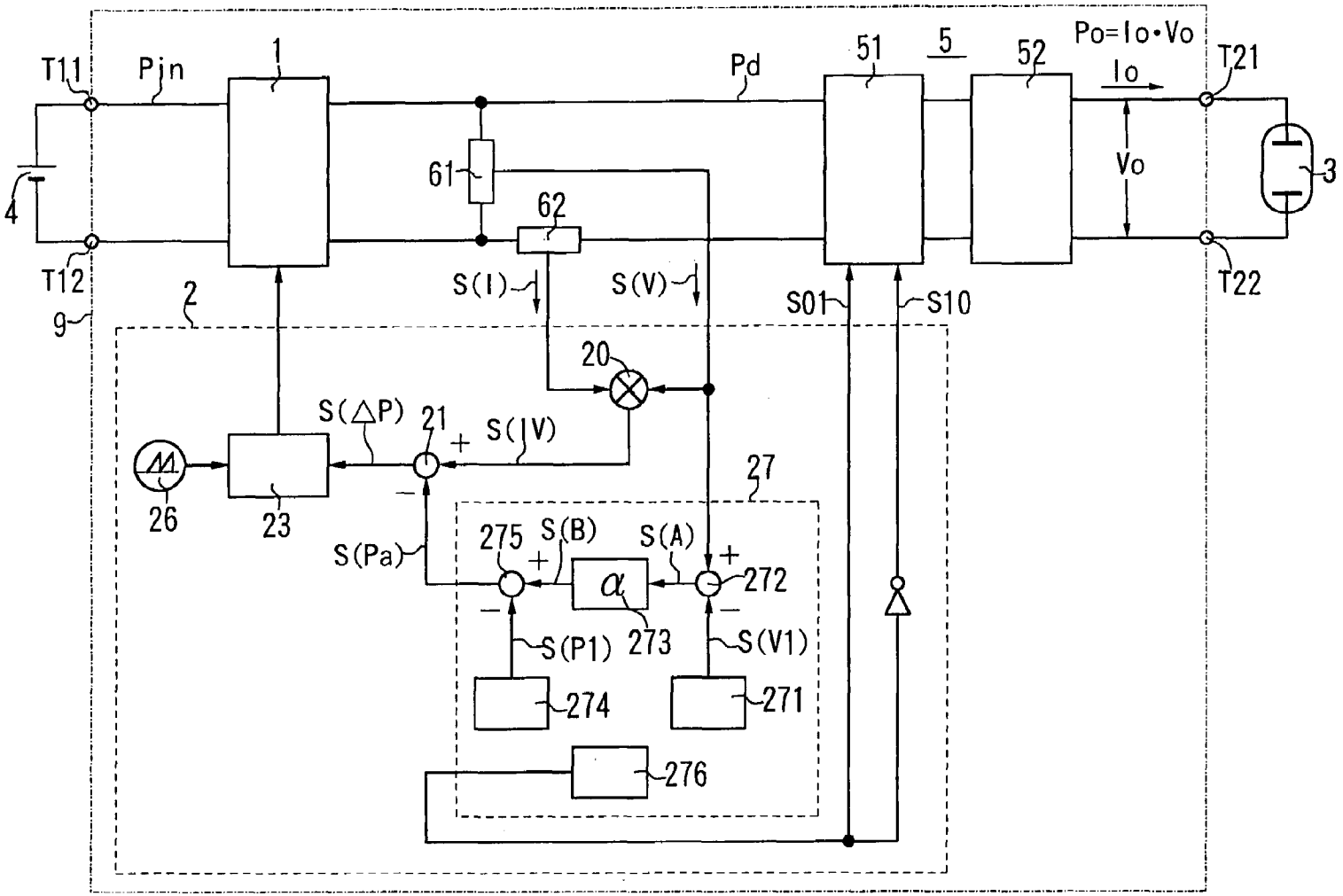
FIG. 7 is a block diagram depicting another embodiment of the discharge lamp lighting apparatus according to the present invention.

FIG. 7 is a block diagram depicting another embodiment of the discharge lamp lighting apparatus according to the present invention. Just like the embodiment shown in FIG. 4, the signal processing section 27, to which the voltage detection signal S(V) is supplied, outputs the power command signal S(Pa) according to the voltage detection signal S(V) in this embodiment as well.

Compared with the embodiment shown in FIG. 4, in this embodiment, the signal processing section 27 comprises a predetermined value setting section 271, a signal generating section 272, a computing processing section 273, a steady-state power value setting section 274, a power command signal generating section 275, and a drive pulse signal generating section 276. This signal processing section 27, however, is for performing the power control described in FIG. 2.

As FIG. 7 shows, the predetermined value setting section 271 outputs a predetermined value signal S(V1). The predetermined value signal S(V1), which indicates the predetermined value V1, is set to be a constant.

To the signal generating section 272, the abovementioned voltage detection signal S(V) is supplied, and the predetermined signal S(V1) is supplied from the predetermined value setting section 271. The AC voltage Vo is indicated by the voltage detection signal S(V), and the predetermined value V1 is indicated by the predetermined value signal S(V1).

When the AC voltage Vo is lower than the predetermined value V1, the signal generating section 272 outputs the difference signal S(A) corresponding to the difference between the voltage detection signal S(V) and the predetermined value signal S(V1). The value A of the difference signal S(A) is given by (V1−Vo).

When the AC voltage Vo is not lower than the predetermined value V1, the signal generating section 272 makes the value A of the difference signal S(A) to be zero. Rather than make the value A of the difference signal S(A) to be zero, the output of the difference signal may be stopped.

The computing processing section 273, to which the difference signal S(A) is supplied from the signal generating section 272, computes the difference signal S(A) to output the computing process signal S(B). The value B of the computing process signal S(B) is given by (α·A) using the value A of the difference signal S(A). Namely, this computing processing section 273 performs computing process such that the value A of the difference signal S(A) is multiplied by α. The computing process is not limited to this, but various computing processes may be used according to the discharge characteristic of the discharge lamp.

The steady-state power value setting section 274 outputs the steady-state power value signal S(P1). The steady-state power value signal S(P1) indicates the steady-state power value PI, which is set to be a constant.

To the power command signal generating section 275, the computing process signal S(B) is supplied from the computing processing section 273, and the steady-state power value signal S(P1) is supplied from the steady-state power value setting section 274. The power command signal generating section 275 outputs the power command signal S(Pa) corresponding to the difference between the computing process signal S(B) and the steady-state power value signal S(P1). The power command value Pa indicated by the power command signal S(Pa) is given as follows.

When $Vo>V1$, $Pa=P1$.

When $Vo<V1$, $Pa=P1-\alpha\cdot(V1-Vo)$.

As described above, the signal processing section 27 outputs the power command signal S(Pa) according to the voltage detection signal S(V).

The abovementioned signal processing section 27 is for the power control described in FIG. 2, but an expert skilled in this field could easily think of the signal processing section for the power control described in FIG. 3.

The abovementioned signal processing section 27 can be comprised of an analog circuit. A configuration example using an analog circuit will now be described.

Figure 8:
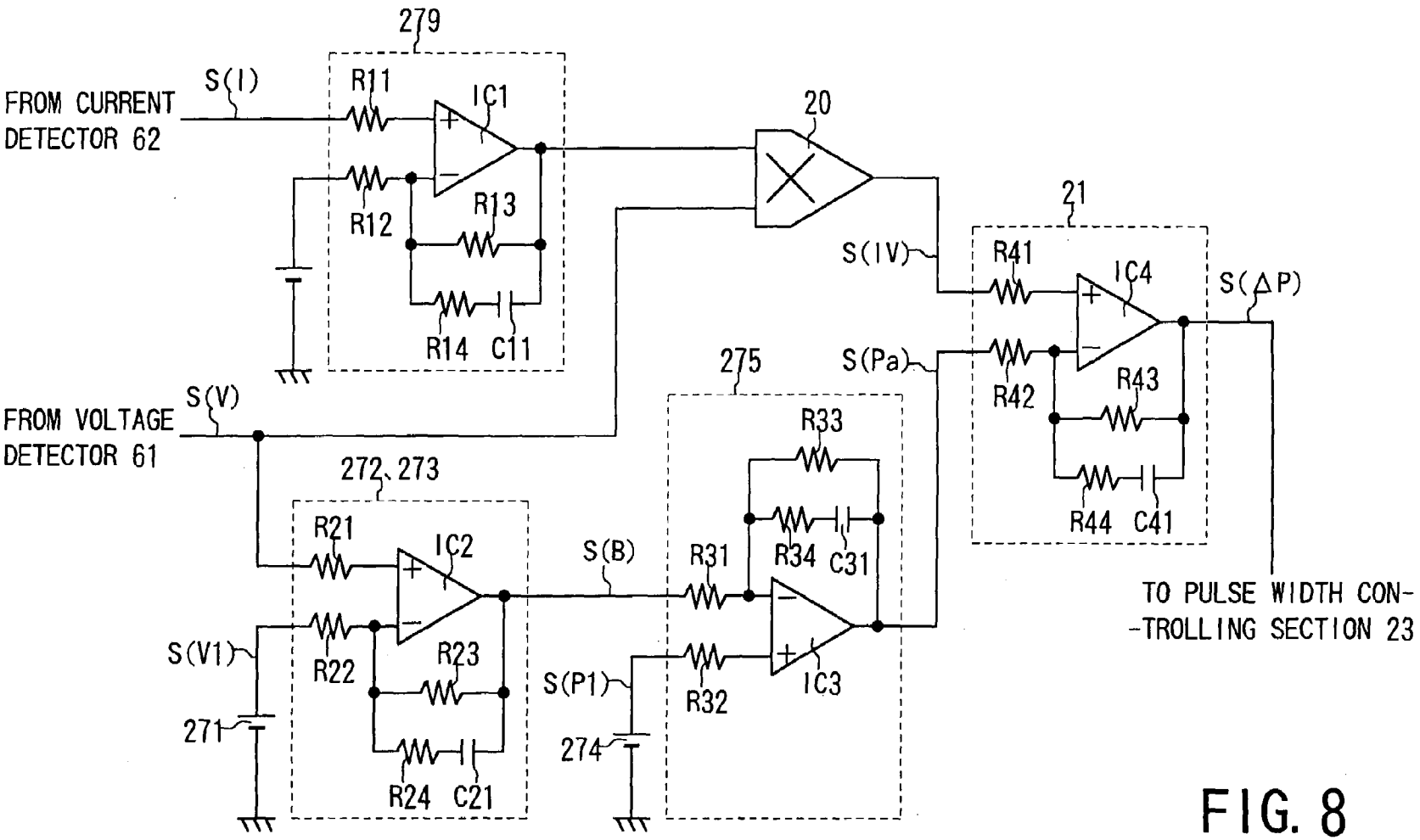
FIG. 8 is a circuit diagram depicting a part of the controller included in the discharge lamp lighting apparatus shown in FIG. 7.

FIG. 8 is a circuit diagram depicting a part of the controller included in the discharge lamp lighting apparatus shown in FIG. 7. The power computing section 20 is comprised of a multiplier.

The predetermined value setting section 271 included in the signal processing section 27 (see FIG. 7) is comprised of a DC voltage source. The signal generating section 272 and the computing processing section 273 are integrated, which is comprised of an arithmetic circuit using an operational amplifier. The steady-state power value setting section 274 is comprised of a DC voltage source. And the power command signal generating section 275 is comprised of an arithmetic circuit using an operational amplifier.

The signal generating section 21 is comprised of an arithmetic circuit using an operational amplifier.

Figure 9:
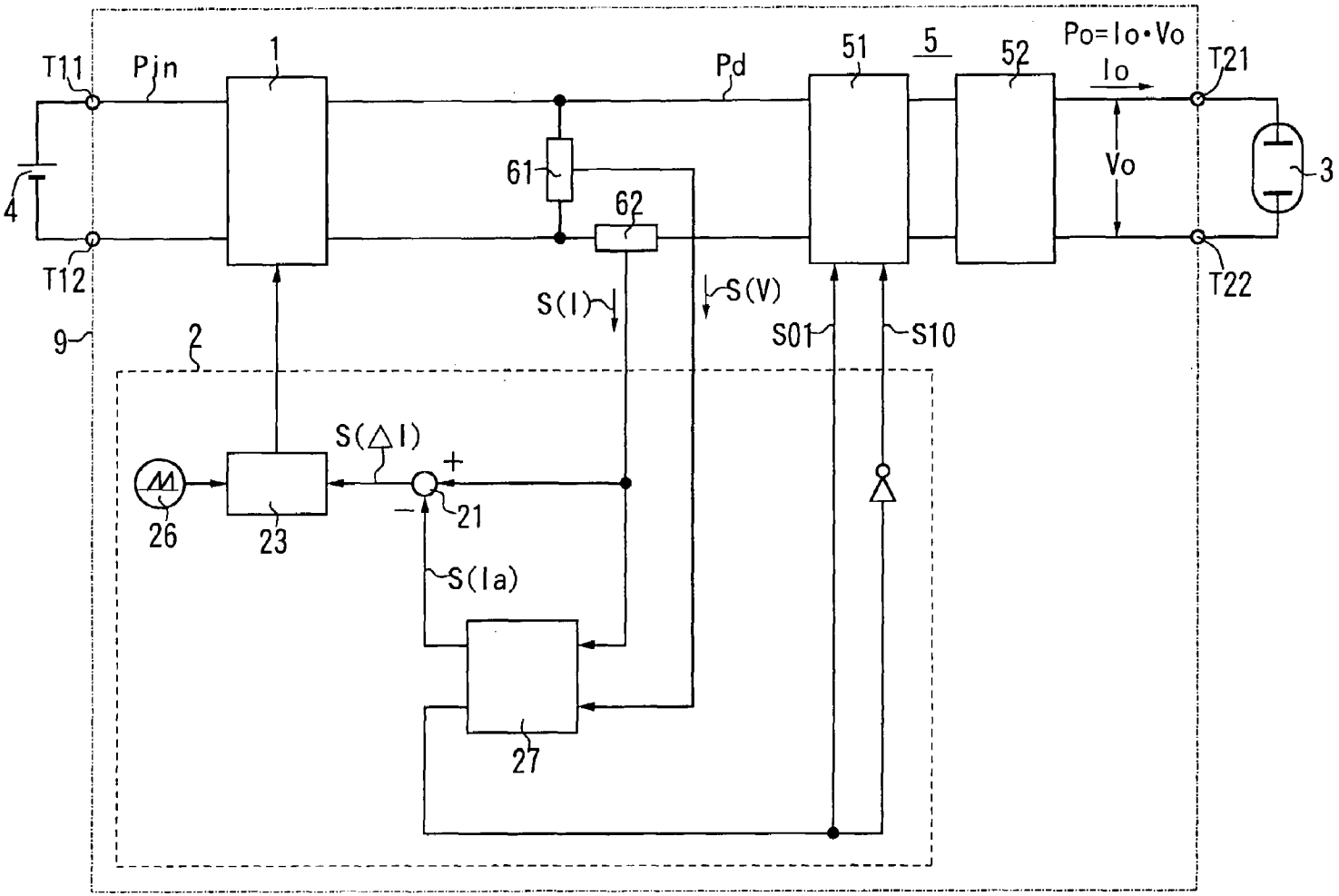
FIG. 9 is a block diagram depicting still another embodiment of the discharge lamp lighting apparatus according to the present invention.

FIG. 9 is a block diagram depicting still another embodiment of the discharge lamp lighting apparatus according to the present invention. Compared with the embodiment shown in FIG. 4, this embodiment uses the current command signal S(Ia) for control of the AC power Po, and the controller 2 comprises a signal processing section 27, a signal generating section 21, and a pulse width controlling section 23 as a concrete configuration thereof.

To the signal processing section 27, the voltage detection signal S(V) is supplied from the voltage detector 61, and the current detection signal S(I) is supplied from the current detector 62, and the signal processing section 27 outputs the current command signal S(Ia) according to the voltage detection signal S(V) and the current detection signal S(I).

To output the current command signal S(Ia), the signal processing section 27 calculates the AC power Po from the voltage detection signal S(V) and the current detection signal S(I). And the signal processing section 27 calculates the power command value Pa according to the AC voltage Vo shown by the voltage detection signal S(V). For the calculation process of the power command value Pa, the calculation process shown in FIG. 5 may be performed, or the calculation process shown in FIG. 6 may be performed.

Then the signal processing section 27 compares the abovementioned AC power Po and the power command value Pa to output the current command signal S(Ia) such that the difference between the AC power Po and the power command value Pa becomes zero.

To the signal generating section 21, the current detection signal S(I) is supplied from the current detector 62, and the current command signal S(Ia) is supplied from the signal processing section 27. And this signal generating section 21 outputs the signal S(ΔI) corresponding to the difference between the current detection signal S(I) and the current command signal S(Ia).

The pulse width controlling section 23 provides pulse width control to the power conversion circuit 1 comprised of a DC-DC converter based on the signal S(ΔI) supplied from the signal generating section 21. This pulse width control is the same as the pulse width control in the embodiment shown in FIG. 4.

When the power conversion circuit 1 (DC-DC converter) performs the switching operation by the abovementioned pulse width control, the voltage and the current which appear at the output side of the power conversion circuit 1 are detected by the voltage detector 61 and the current detector 62. And the voltage detection signal S(V) and the current detection signal S(I) are supplied to the signal processing section 27, and the current command signal S(Ia) is supplied from the signal processing section 27 to the signal generating section 21. Also the abovementioned current detection signal S(I) is supplied to the signal generating section 21.

In the signal generating section 21, the current detection signal S(I) from the current detector 62 is compared with the current command signal S(Ia) from the signal processing section 27, and the signal S(ΔI) corresponding to the difference thereof is generated. And by the pulse width control section 23, the pulse width control according to the signal S(ΔI) is provided to the power conversion circuit 1. The pulse width control direction in this case is a direction where the difference between the current detection signal S(I) and the current command signal S(Ia) decreases.

The abovementioned feedback control provides control to make the difference between the current detection signal S(I) and the current command signal S(Ia) of the signal processing section 27 to be zero. By this, the difference between the AC power Po and the power command value Pa of the signal processing section 27 approaches zero. In this way, control of the AC power Po can also be implemented by using the current command signal S(Ia).

Figure 10:
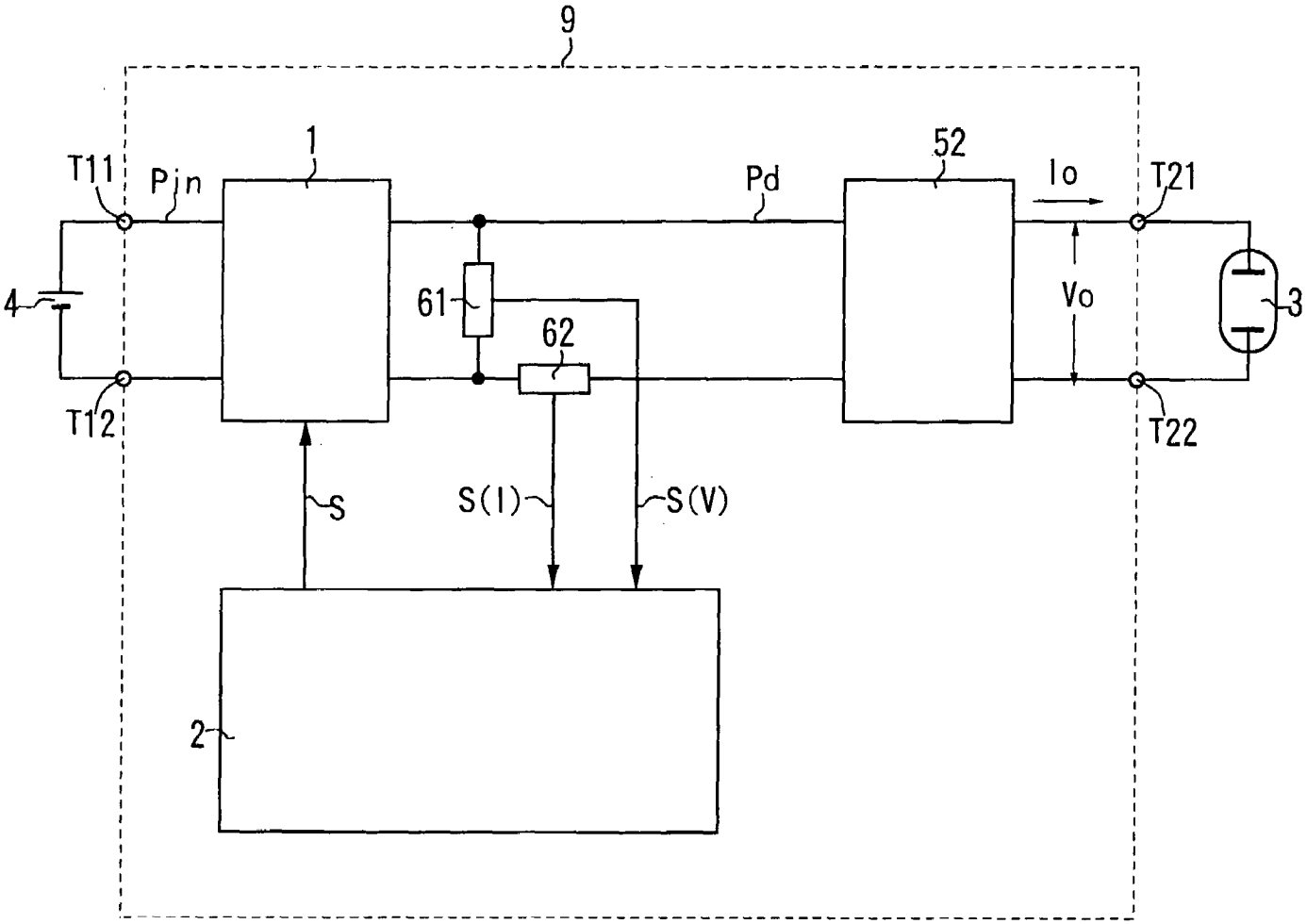
FIG. 10 is a block diagram depicting still another embodiment of the discharge lamp lighting apparatus according to the present invention.

FIG. 10 is a block diagram depicting still another embodiment of the discharge lamp lighting apparatus according to the present invention. In FIG. 10, the same composing elements as the composing elements which appear in previous drawings are denoted with the same reference symbols, for which redundant descriptions are omitted.

The discharge lamp lighting apparatus shown in FIG. 10 comprises a power conversion circuit 1, high voltage generator 52, and a controller 2. Unlike the embodiments shown in FIG. 1, FIG. 4, FIG. 7 and FIG. 9, the inverter is not included.

The power conversion circuit 1 converts the input power Pin into the DC power Pd. The high voltage generator 52 receives the supply of the DC power Pd from the power conversion circuit 1, and outputs the DC voltage Vo and the DC current Io for driving the discharge lamp.

To the controller 2, the signal S(V) corresponding to the DC voltage Vo and the signal S(I) corresponding to the DC current Io are input. When the DC voltage Vo is higher than a predetermined value, the controller 2 provides constant power control for maintaining the DC power Po=Io·Vo provided by the DC voltage Vo and the DC current Io to be constant to the power conversion circuit 1. When the DC voltage Vo is lower than the predetermined value, the controller 2 provides power reduction control for reducing the DC power Po to the power conversion circuit 1.

The discharge lamp lighting apparatus according to this mode as well exhibits a functional effect similar to the previously mentioned discharge lamp lighting apparatuses.

In each embodiment described above, a single discharge lamp is lit, but an expert skilled in this field could easily think of a configuration for lighting a plurality of discharge lamps, and it is obvious that the same functions and effects can be obtained in this case as well.

As described above, according to the present invention, the following effects can be obtained.

(a) Provides a discharge lamp lighting apparatus which can prevent an increase of loss in an area where the discharge lamp tube voltage is low, and a discharge lamp apparatus using this discharge lamp lighting apparatus.

(b) Provides a discharge lamp lighting apparatus which can prevent a rise in the temperature in an area where the discharge lamp tube voltage is low, and a discharge lamp apparatus using this discharge lamp lighting apparatus.

The invention claimed is:

1. A discharge lamp lighting apparatus comprising a power conversion circuit, a high voltage generator, and a controller, wherein;

said power conversion circuit converts input power to output DC power;

said high voltage generator receives DC power from said power conversion circuit to output DC voltage and DC current for lighting a discharge lamp; and said controller, receives a signal corresponding to said DC voltage and a signal corresponding to said DC current and controls said power conversion circuit such that DC power is reduced to be maintained lower than steady state-power of said discharge lamp while said DC voltage is lower than a predetermined value and DC power is maintained to the steady-state power while said DC voltage is higher than said predetermined value.

2. A discharge lamp apparatus comprising a discharge lamp lighting apparatus and at least one discharge lamp, wherein;

said discharge lamp lighting apparatus comprises a power conversion circuit, a high voltage generator, and a controller;

said power conversion circuit converts input power to output DC power;

said high voltage generator receives DC power from said power conversion circuit to output DC voltage and DC current for lighting said at least one discharge lamp;

said controller receives a signal corresponding to said DC voltage and a signal corresponding to said DC current and controls said power conversion circuit such that DC power is reduced to be maintained lower than steady-state power of said at least one discharge lamp while said DC voltage is lower than a predetermined value and DC power is maintained to the steady-state power while said DC voltage is higher than said predetermined value; and said at least one discharge lamp is connected to the output side of said high voltage generator.

* * * * *